US005411345A

United States Patent [19]

Ueji et al.

[11] Patent Number: 5,411,345

[45] Date of Patent: May 2, 1995

[54] FELT-TIPPED PEN TYPE ADHESIVE APPLIER

[75] Inventors: Kenji Ueji; Kiichi Ito, both of Sakai; Masakazu Komemushi, Hirakata, all of Japan

[73] Assignee: Konishi Co., Ltd., Osaka, Japan

[21] Appl. No.: 144,218

[22] Filed: Oct. 28, 1993

Related U.S. Application Data

[63] Continuation of Ser. No. 907,809, Jul. 2, 1992, abandoned.

[51] Int. Cl.[6] ..... B43K 8/02

[52] U.S. Cl. ..... 401/206; 401/199

[58] Field of Search ..... 401/205, 206, 199

[56] References Cited

U.S. PATENT DOCUMENTS

| | | | |
|---|---|---|---|
| 2,623,227 | 12/1952 | Moonert | 401/206 |
| 3,113,336 | 12/1963 | Langnickel | 401/206 |
| 3,551,065 | 12/1970 | Molin et al. | 401/206 |
| 4,446,274 | 5/1984 | Okazaki et al. | 524/812 |
| 4,913,175 | 4/1990 | Yokosuka et al. | 401/206 M |
| 4,923,317 | 5/1990 | Bishop et al. | 401/205 |
| 4,948,822 | 8/1990 | Iovine et al. | 523/201 |
| 5,082,386 | 1/1992 | Hironaka et al. | 401/206 |

FOREIGN PATENT DOCUMENTS

| | | | |
|---|---|---|---|
| 1049071 | 10/1953 | France | 401/206 |
| 60-90160 | 6/1985 | Japan . | |
| 62-28584 | 2/1987 | Japan . | |
| 62-283177 | 12/1987 | Japan . | |
| 2-8282 | 1/1990 | Japan . | |
| 3-79989 | 8/1991 | Japan . | |

*Primary Examiner*—Steven A. Bratlie
*Attorney, Agent, or Firm*—Hopkins & Thomas

[57] ABSTRACT

Disclosed is a felt-tipped pen type adhesive applier comprising: a container for adhesive; valve mechanism provided on the container for controllably supplying the adhesive from the container; and a server for receiving the adhesive supplied through the valve mechanism in order to serve the adhesive. The server comprises: a holder covering the outside of the valve mechanism; a member permeable to the adhesive and extending from the inside of the holder to the outside thereof and being axially slidably and fittingly supported by the holder, the permeable member cooperating with the valve mechanism to operate the valve mechanism in response to axial movement of the permeable member; a support for slidably and fittingly supporting the permeable member inside of the holder to facilitate transportation of the adhesive from the valve mechanism to the permeable member; and mechanism for preventing the adhesive from leaking out of the server due to pressure change inside the server. The preventing mechanism includes a pair of notches which are symmetrically formed on the support with respect to the permeable member. Water emulsion adhesive is stored in the container.

18 Claims, 3 Drawing Sheets

FELT-TIPPED PEN TYPE ADHESIVE APPLIER

This is a continuation of application Ser. No. 07/907,809 filed on Jul. 2,1992 now abandoned.

BACKGROUND OF THE INVENTION

1. Field of the Invention

The present invention relates to an adhesive applier, in particular, to a pen-type adhesive applier having a longitudinal container, in which the adhesive is stored, and at the upper tip of which a permeable wick is supported so that the adhesive penetrates through the wick in order to be applied to paper and the like.

2. Description of the Prior Art

Many kinds of paste-type adhesive materials such as starch, gum arabic, water-soluble cellulose derivatives, water-soluble polyvinyl alcohol and the like are known as adhesive materials or glues for paper and are in great demand for use with stationary, office supplies and the like. However, in accordance with a recent trend toward higher convenience, there is a need for an adhesive applier unit that can be used easily without soiling the user's hands or surroundings with the adhesive. For this reason, stick-type solid adhesive, bottled adhesive in which gum arabic, water-soluble polyvinyl alcohol liquid or the like is contained in a sponge-tipped bottle and the like are presently on the market. Certaily, these products can be easily handled. Nevertheless, these products demonstrate some disadvantages, as well. Specifically, the stick-type adhesive is poor in adherence and serviceability because of its solidity. On the other hand, the ability of the bottled adhesive to penetrate readily through the sponge deteriorates due to the hardened adhesive at the sponge, and it is rather difficult to control during application due to undesirable oozing from the sponge caused by pressure change of the air closed inside the bottle.

SUMMARY OF THE INVENTION

With these problems in mind, it is the object of the present invention to provide a novel adhesive applier which can be easily and conveniently handled without soiling the user's hands and surroundings, that is, a felt-tipped type adhesive applier in which the undesirable ooze of the adhesive can be prevented.

In order to achieve the above-mentioned object, an adhesive applier according to the present invention comprises: a container for adhesive; valve means provided on the container for controllably supplying the adhesive from the container; and a server for receiving the adhesive supplied through the valve means in order to serve the adhesive, the server comprises: a holder covering the outside of the valve means; a member permeable to the adhesive and extending from the inside of the holder to the outside thereof and being axially slidably and fittingly supported by the holder, the permeable member cooperating with the valve means to operate the valve means in response to axial movement of the permeable member; a support for slidably and fittingly supporting the permeable member inside of the holder to facilitate transportation of the adhesive from the valve means to the permeable member; and means for preventing the adhesive from leaking out of the server due to pressure change inside the server.

Another adhesive applier according to the present invention comprises: a container for adhesive; piston means including a chamber and a slide member permeable to the adhesive, the chamber being communicated with the container, and the slide member being axially slidably supported in the chamber and extending to the outside of the chamber; valve means provided between the container and the chamber of the piston means so as to cooperate with the slide member to controllably supply the adhesive from the container to the chamber in response to axial movement of the slide member; a support slidably and fittingly supporting the slide member in the chamber of the piston means to facilitate transportation of the adhesive in the chamber to the slide member; and means for preventing the adhesive from leaking out of the piston means due to pressure change inside the chamber.

BRIEF DESCRIPTION OF THE DRAWINGS

The features and advantages of the adhesive applier according to the present invention over the proposed products will be more clearly understood from the following description of the preferred embodiments of the present invention taken in conjunction with the accompanying drawings in which like reference numerals designate the same or similar elements or sections throughout the figures thereof and in which.

DETAILED DESCRIPTION OF THE PREFERRED EMBODIMENTS

Figure 1B:
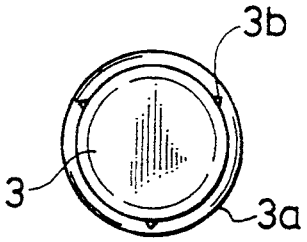
FIGS. 1(*a*) and 1(*b*) are a side view and a top view, respectively, showing a first embodiment of the adhesive applier according to the present invention.

Referring now to the drawings, preferred embodiments of the adhesive applier according to the present invention will be described.

Figure 1A:
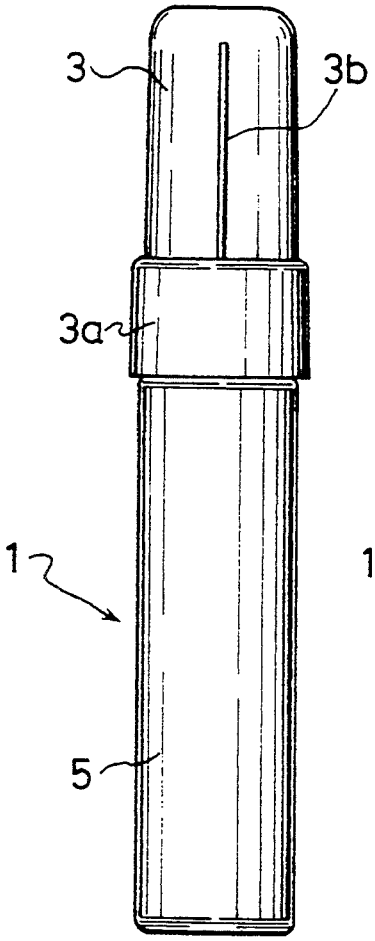
Figure 2:
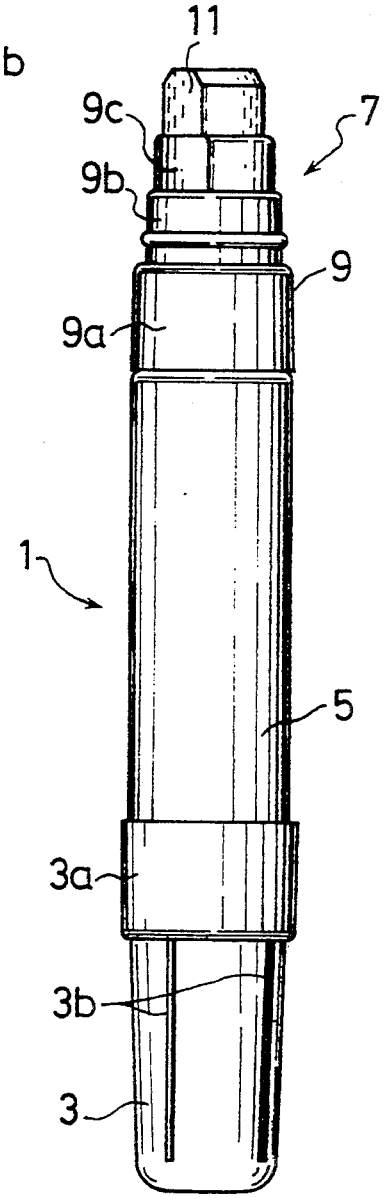
FIG. 2 is a side view showing the adhesive applier of FIG. 1 in which a cap is fitted on the bottom end of the applier.

FIGS. 1(*a*), 1(*b*) and 2 show the first embodiment of the pen-type adhesive applier according to the present invention. Specifically, the adhesive applier comprises a body 1 and a cap 3 which is to be removably fitted on the body 1. The body 1 includes a cylindrical bottle 5 which contains adhesive liquid therein and a server part 7 which is fixedly screwed on the bottle 5 to serve the adhesive liquid on a material to which the adhesive is to be applied. The server part 7 includes a holder case 9 and a wick 11 made of a permeable material such as fibrous material, porous material or the like. The wick 11 is positioned at the upper tip of the holder case 9, so that the adhesive supplied from the bottle 5 in the server portion penetrates the permeable wick 11. In view of the need for penetration by liquid and resistance to abrasion and pressure created during use, such a wick is preferably made of a felt material. For the adhesive applier of the present invention, a wick made of a polyolefin-fiber felt material having a density of 0.1–0.4 g/cm$^3$ and a porosity of 77±10% can be preferably utilized. The wick 11 is shaped into a tapered square pole. However, other axial shapes such as various cylinders, polygonal poles and the like may also serve as the wick 11 as the occasion arises.

The holder case 9 has a thread part 9a, a chamber part 9*b* and an opening part 9*c*. The thread part 9*a* is formed with an inverse helical gash on the inner bore thereof so as to be screwed on a slightly narrowed neck part 5*a* of the bottle 5 whose outer side is also threaded accordingly. The lateral widths of the thread part 9*a*, the middle part 9*b* and the opening part 9*c* are narrowed according to elevation, and the opening part 9*c* holds the wick 11 in such a manner that the wick 11 can slide along the longitudinal direction of the cylindrical bottle 5, like a piston. The wick 11 cooperates with a valve mechanism incorporated in the applier 1, the details of which will be described hereinafter.

The cap 3 is formed with a skirt portion 3*a* and three raised straight lines 3*b* which serve as non-slips as shown in FIGS. 1(*a*) and 1(*b*). An inner bore of the skirt portion 3*a* is sized so as to fit on both the thread part 9*a* and the bottom of the cylindrical bottle 5, as shown in FIGS. 1(*a*) and 2.

Figure 3:
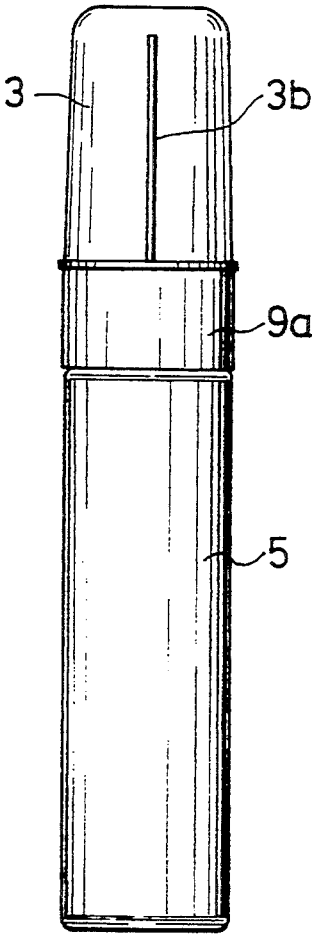
FIG. 3 is a side view showing a modification of the first embodiment of the applier.

FIG. 3 shows a modification of the cap 3 in which no skirt portion is provided. This modification is advantageous in that the server 9 can be prevented from being mistakingly removed from the container 5 while removing the cap 3. Namely, since the user can grasp bottle 5 at the thread portion 9*a*, the server 9 need not be screwed off by the cap 3.

Next, referring to FIGS. 4 and 5, construction and operation of the valve mechanism employed in the adhesive applier according to the present invention will be described below.

The valve mechanism is generally costructed by a first packing 13, a valve shaft 15 and a second packing 17.

The first packing 13 has a cylindrical side wall 13*a* which is fitted to the inner bore surface of the neck 5*a* by pressing it in the neck part 5*a* of the bottle 5. Insertion of the first packing 13 is stopped by a flange portion 13*b* which is formed bent significantly outwards from the top end of the side wall 13*a*, and the flange portion 13*b* prevents liquid from leaking out. The lower portion of the side wall 13*a* is slightly tapered and formed with a flat bottom 13*c*. The bottom 13*c* has a guide port 19 at the center thereof, and a plurality of guide ribs 13*d* extend downwards along the axial direction of the cylindrical wall 13*a* around the guide port 19.

The valve shaft 15 is axially and movably arranged inside the first packing 13. It has a conical valve body 15*b* which extends downwards. The lower tip of the valve shaft 15 is slidably guided by the guide ribs 13*d* through the port 19, and received at a stepped portion 15*a* by the bottom 13*c*.

The second packing 17 includes an annular base 17*a*, a side wall 17*b* which extends vertically, a center valve port 17*c* and a valve seat 17d which is formed around the valve port 17*c* inside the side wall 17*b*. When the second packing 17 is inserted in the side wall 13*a* of the first packing 13, the upper portion of the valve shaft passes through the valve port 17*c*. Resting on an annular stopper 23 of the bottom 13*c* and positioned between the valve body 15*a* and the bottom 13*c*, a helical spring 21 is arranged so as to urge the valve body 15*b* upwards to close the valve port 17*c*, as shown in FIG. 4. Moreover, the bottom 13*c* has a plurality of openings 25 around the stopper 23 for communicating the inside of the bottle 5, or an adhesive chamber 5*b*, with the inside of the first packing 13, or a valve chamber 13*e*.

The wick 11 is arranged on the valve shaft 15 at the opening part 9*c*. In this way, the wick is movable along the axial direction of the valve shaft 15, the direction of which is denoted by an arrow A in FIG. 5.

Figure 5:
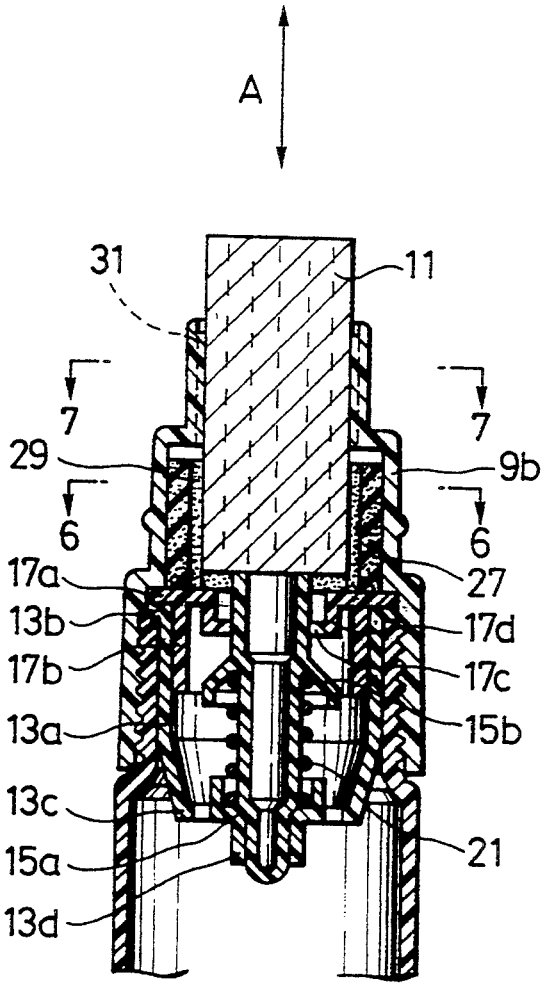
FIG. 5 is a sectional view of a main portion of the adhesive applier shown in FIG. 4 for explanation of a valve mechanism incorporated in the first embodiment.

According to the above construction, when the wick 11 is pressed down into the holder case 9 along the axial direction as shown in FIG. 5, the valve shaft 15 with the valve body 15*b* is pushed axially downwards against the spring 21 by the wick 11 so as to open the valve port 17*c*. Therefore, if the wick 11 is pressed into the holder 9 while turning the adhesive applier 1 upside down, the adhesive liquid flows from the adhesive chamber 5*b* through the openings 25 and the valve port 17*c* into a chamber 10 inside the chamber part 9*b* to be received by the wick 11. The adhesive then penetrates the wick 11 and passes to the outside of the server 7. Therefore, if the user holds the adhesive applier 1 in his hand in a manner similar to the way in which one holds a pen and presses the wick 11 on a paper sheet or the like, the adhesive liquid seeps through the wick 11 to be applied on the sheet. After releasing the wick 11 from the pressure pushing it into the holder 9, the valve body 15*b* is forced by the spring 21 to close the port 17*c*. As a result, the user can easily control the amount of the adhesive supplied from the applier 1 by appropriately regulating the amount of time during which pressure is applied to the wick.

Figure 6:
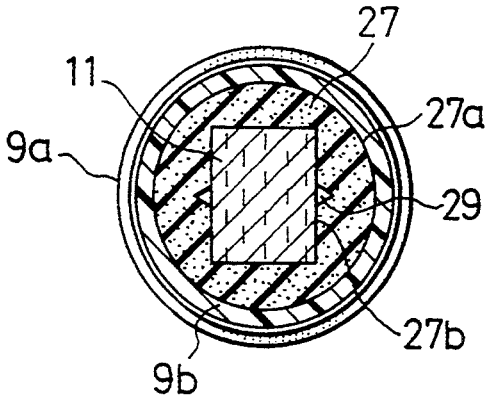
FIG. 6 is a cross-sectional view of the adhesive applier taken along line 6—6 of FIG. 5.

In the present invention, a support 27 is provided for facilitating transportation of the adhesive liquid from the valve port 17*c* to the wick 11. Specifically, as shown in FIGS. 5 and 6, the support 27 has a cylindrical outer side surface 27*a* and a square-pole inner bore 27*b*. The outer side surface 27*a* is fittingly received by the inner side of the chamber part 9*b* of the holder case 9, and the inner bore 27*b* fittingly and slidably supports the wick 11. The support is made of porous material. Here, it should be noted that open-cell material is preferably employed as the support, because the open-cell material can easily and smoothly carry liquid therethrough due to continuity of the cells. Preferable ranges of the density and the open-cell rate for the support material are 30 to 80 g/m$^3$ and 70 to 100% by volume, respectively. In this embodiment, polyurethane open-cell foam having a density of about 50±5 g/m$^3$ and an open-cell rate of about 97% by volume is utilized for the support. According to this construction, the adhesive liquid supplied from the valve port 17*c* is rapidly sucked up through the support 27 into the wick 11. Moreover, the support also has a retainability which is effective for control of liquid transportation, in that the liquid can be carried in moderate amounts.

Here, it should be noted that one problem with the above construction remains to be solved. Namely, if the support 27 completely fills the space laterally between the wick 11 and the chamber part 9*b* of the holder case 5, air cannot escape from the space surrounded by the wick 11, the support 27 and the valve body 15. Accordingly, adhesive held in the wick 11 and the support 27 may undesirably leak out, being pushed by air pressure which fluctuates due to temperature change.

To solve the above-described problem, the support 27 according to the present invention has ooze prevention means. Namely, as clearly shown in FIG. 6, a pair of notches 29 are formed on the inner bore 27*b* and are positioned radially symmetrically with respect to the axial direction A of the valve shaft 15. The notches lie axially along the wick 11 to release the air inside the support 27. The notch may be formed, alternatively, on the wick, and a conduit formed at the center of the wick 11 so as to pass through the wick longitudinally can be also used alternatively. Of course, the notch can be substituted with a recess having another shape like a semicylindrical shape. The width of the notch can be preferably set within the range of about 0.1 to 3 mm within a limitaion of not decreasing the strength of the supporter. Formation of an excessively large notch may cause the liquid to trickle out threthrough. Two or more notches can be preferably formed, and are desirably located in a symmetrical manner so as to allow the air easily escape. These notches have a further advantage in that the air communication between the outside and the inside of the supporter 27 which is achieved by the notches facilitates smooth sucking of the adhesive liquid into the wick 11. This is because the notches allow the surrounding atmospheric air to enter the holder case 9 thereby removing the hindrance to the suction of the adhesive caused by the pressure difference between the inside of the holder case 5 and its outside surroundings.

Figure 7:
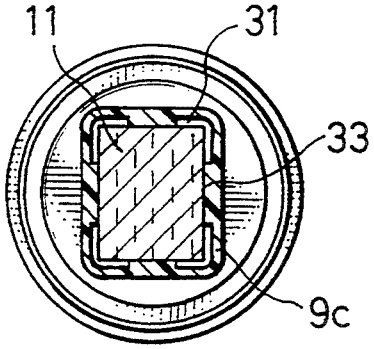
FIG. 7 is a cross-sectional view of the adhesive applier taken along line 7—7 of FIG. 5.

Moreover, a plurality of clearances 31 between the wick 11 and the opening part 9*c* of the holder case 9 are provided, as shown in FIG. 7. In other words, the square pole wick 11 is supported by four support pieces 33 which project slightly inwards from the inner side surface of the opening part 9*c*, thereby spacing each of the corners of the opening part 9*c* from the wick 11. Accordingly, the air, passing through the notches 29, can escape via the clearances 31.

Figure 8:
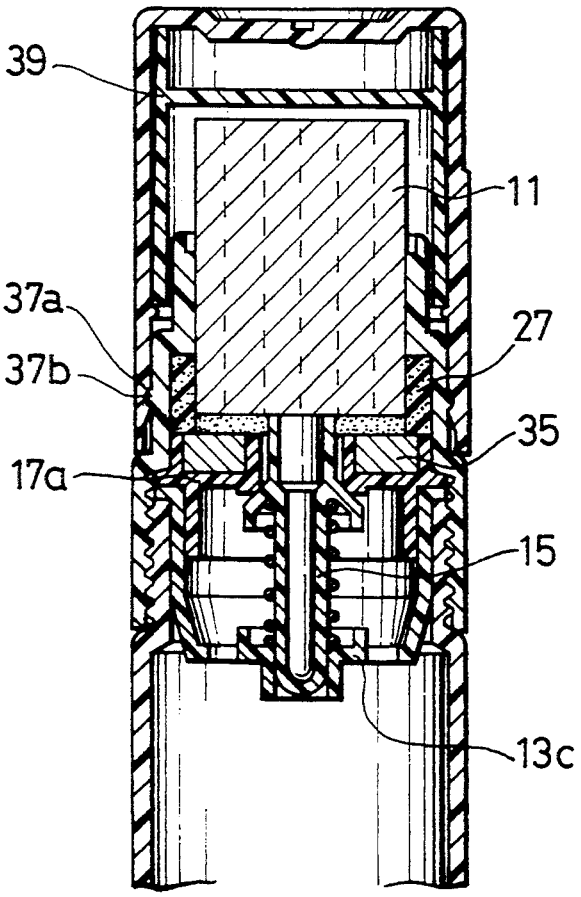
FIG. 8 is an axial sectional view of a main portion of a second embodiment of the applier.

FIG. 8 shows the second embodiment of the adhesive applier according to the present invention. In this embodiment, an annular elastic pad 35 is provided between the wick 11 and the base 17*a* of the second packing 17. This pad 35 is made of a material through which the adhesive liquid cannot permeate. Since aqueous emulsion liquid is employed as the adhesive liquid in the present invention as described hereinafter, materials which are water resistant are preferably utilized for the pad.

During operation, if the wick 11 is pressed into the holder case 9, the bottom end of the wick 11 reaches the upper surface of the pad 35 to contact therewith. In this way, there is no space between the wick 11 and the pad 35. Accordingly, it becomes possible to completely remove the air from the space below the wick 11. Therefore, adhesive leakage caused by changes in air pressure can be decreased.

Of course, both ooze prevention means in the first and second embodiments, namely, the notches of the supporter and the annular pad, can be employed in combination.

In the embodiment shown in FIG. 8, the valve shaft 15 has no raised portion to stop the insertion of the valve shaft 15. However, since insertion of the wick 11 is stopped by the pad 35, additional stopper means are not required.

Figure 4:
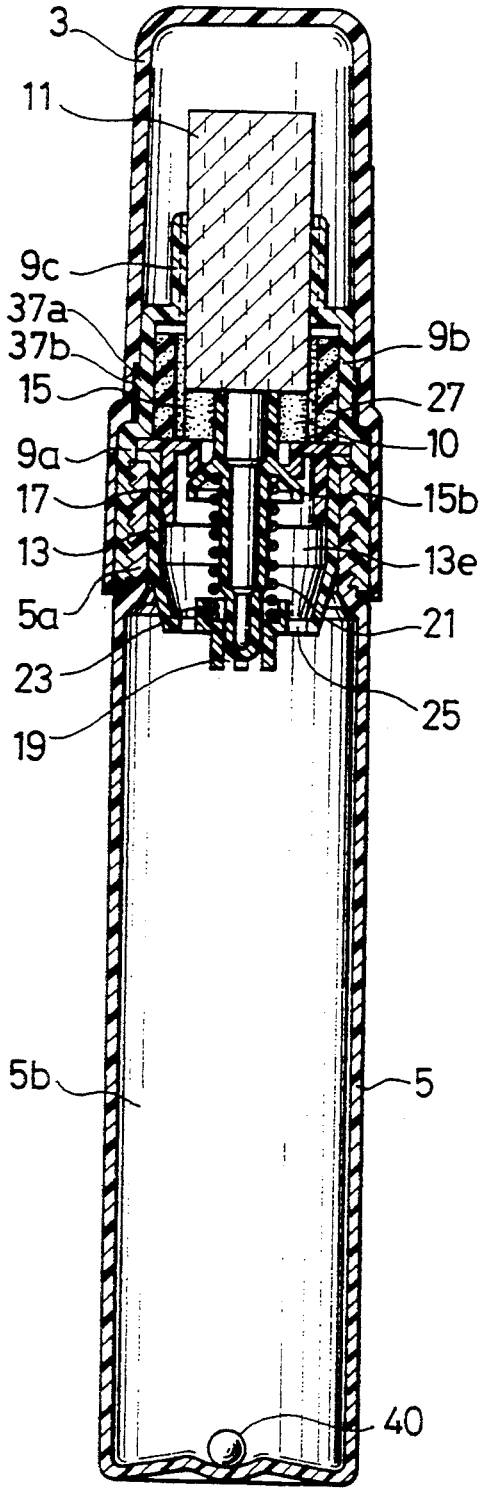
FIG. 4 is an axial sectional view showing the adhesive applier shown in FIG. 1(*a*)

In addition to the above, as shown in FIGS. 4 and 5, the adhesive applier of the present invention can be provided with a circumferential stopper projection 37*a* on the outer peripheral surface of the chamber part 9*b* and a stopper recess 37*b* on the inner periphery of the cap 3 so as to elastically engage with each other when fitting the cap 3 on the server 7.

Moreover, as shown in FIG. 8, the adhesive applier of the present invention may be further provided with an inner cap 39 for reinforcement of the cap 3. The inner cap 39 can also serve for regulation of the volume of th space surrounding the wick inside the cap 3.

Figure 9:
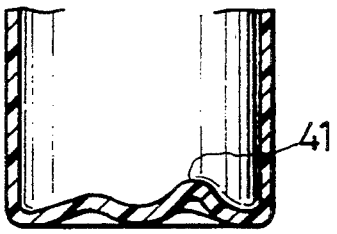
FIG. 9 is an axial sectional view of the bottom portion of the adhesive applier.

The adhesive applier of FIG. 4 can include a stirring ball 40 in the bottle 5. However, it can be substituted with a projection 41 provided inside the bottle 5 as shown in FIG. 9. If the bottle 5 is moved or swayed, the liquid inside the bottle is disturbed by the projection 41 so as to be stirred.

Next, adhesive liquid preferably used with the adhesive applier according to the present invention will be described below.

In the present invention, water emulsion adhesives are preferable for use with the felt-tipped pen type applier. Water emulsion adhesives are generally prepared by polymerization of an adhesive monomer emulsion in which adhesive monomer molecules are dispersed in water and surrounded by emulsifier (surfactant) molecules. Thus, the obtained adhesive emulsion liquid contains small micelles of adhesive polymer component enclosed with the emulsifier. When the water emulsion adhesive liquid is applied to a paper sheet, the water solvent rapidly penetrates the paper sheet, while the adhesive particles remain on the surface of the paper, thereby forming a layer of adhesive. Accordingly, the water emulsion adhesive can be suitably used for water-permeable fibrous materials such as paper, cloth, woven and non-woven fabrics, wood fiber and the like, and, if it is utilized for such a material, it is advantageous in that it can be set up fast in comparison with conventional water-soluble paste such as starch and the like. Moreover, since water emulsion adhesive liquid has a relatively low viscosity, it can easily penetrate wicks. Additionally, because of the low volatility of water, it encounters less trouble caused by hardened adhesive forming around the wick. Therefore, water emulsion adhesive is suitable for use with a felt-tipped type adhesive applier according to the present invention.

In general, the size of adhesive micelles and stability of emulsion change according to type and amount of emulsifier used, order of the procedure in which the emulsifier is blended in the preparation process and the like. With regard to micelle sizes, micelles having a diameter within the range of 0.005 to 5 $\mu$m are sufficient for formation of an adhesive layer during the application. Nevertheless, since the size of adhesive polymer micelles affects the ease of penetration of the adhesive liquid through wicks as illustrated in the above description, further regulation of the micelle size to be equal to or less than 0.5 $\mu$m is preferable for the ease of penetration and avoidance of flocculation of the emulsion at the wick. In this regard, water adhesive emulsion can be preferably prepared by the method illustrated hereinafter, so as to create adhesive micelles having a suitable size and stability in accordance with a content and procedural order of the surfactant introduced.

Moreover, a viscosity of the water adhesive emulsion is preferably regulated to 30 mPa.s or less so that the emulsion can easily penetrate the wick.

In order to form a sufficient adhesive layer, the non-volatile content of the adhesive emulsion liquid is preferably set to be equal to or greater than 50% by weight within a limitation of a viscosity such that the liquid can maintain penetration ease.

Here, a preparation method of the water emulsion adhesive for the adhesive applier according to the present invention will be illustrated below. Water emulsion of acrylic ester copolymer can be preferably prepared by the following process.

First, 60 to 99.8 parts by weight of acrylic ester containing an alkyl radical having 4 to 12 carbons (A), 0.2 to 10 parts by weight of polymerizable unsaturated-radical-containing carboxylic acid (B), 0 to 89.8 parts by weight of copolymerizable vinyl-radical-containing monomer (C) and 1 to 12 parts by weight of emulsifier or surfactant (D) are added to 43 to 100 parts by weight of water and dispersed to obtain a water emulsion of mixed monomers. Next, this emulsion is polymerized, using 0.1 to 1 parts by weight of water-soluble polymerization initiator (E), at a temperature of 40° C. to 90° C. in accordance with an ordinary manner used for emulsion polymerization to obtain copolymer emulsion liquid.

Preferred examples for each of materials (A), (B), (C) and (D) are illustrated as follows:

(A): Acrylic acid 2-ethylhexyl ester, acrylic acid buthyl ester, acrylic acid hexyl ester, acrylic acid octyl ester, acrylic acid isononyl ester, methacrylic acid 2-ethylhexyl ester, methacrylic acid buthyl ester, methacrylic acid hexyl ester, methacrylic acid octyl ester, methacrylic acid isononyl ester and the like.

(B): acrylic acid, methacrylic acid, maleic anhydride, crotonic acid, itaconic acid, fumaric acid and the like.

(C): acrylic ester with an alkyl radical having 1 to 3 carbons such as acrylic acid methyl ester, acrylic acid ethyl ester, acrylic acid propyl ester, acrylic acid isopropyl ester, methacrylic acid methyl ester, methacrylic acid ethyl ester, methacrylic acid propyl ester and methacrylic acid isopropyl ester; acrylic acid esters having a hydroxy radical such as acrylic acid 2-hydroxyethyl ester and the like; acrylic amides such as acrylamide, methacrylamide, N-methylolacrylamide, N-methylolmethacrylamide and the like; acrylic nitrils such as acrylonitrile, methacrylonitrile and the like; and vinyl esters such as vinyl acetate, vinyl propyonate and the like.

(D): anionic surfactants such as soap (fatty salt), alkylsulfate, alkylsulfonate, alkylarylsulfonate; and non-ionic surfactants such as polyethylene glycol alkyl ether, polyethylene glycol fatty ester, sorbitan fatty ester, fatty acid monoglyceride.

(E): water-soluble peroxide compounds such as cumene hydroperoxide, di-ter-butylperoxide, potassium peroxodisulfate, dipotassium peroxosulfate, ammonium peroxosulfate, hydrogen peroxide; and redox initiator, or, combination of a peroxide compound (hydrogen peroxide, benzoyl peroxide, cumene hydroperoxide and the like) with a reducing agent (ferrous (II) compound, chromous (II) compound, sulfite, hydroxylamine, hydrazine) such as Fenton's reagent and the like.

Here, in the above-described preparation of the water emulsion adhesive liquid, it should be noted that both the anionic surfactant and non-ionic surfactant are usable as the emulsifier either individuals or together. In accordance with an increase of the amount of emulsifier (D), the obtained micelles can be decreased in size and highly stabilized, thereby inducing stability and easy penetration by the adhesive products. After polymerization, the emulsion liquid is neutralized preferably by using sodium hydroxide or potassium hydroxide. For this treatment, if aqueous ammonia is used instead of the above neutralizer, the pH value of the neutralized emulsion liquid vacillates with time due to gradual escape of ammonia gas. As a result, under the influence of pH change, the emulsion cannot be kept stable. At the same time, the viscosity of the emulsion liquid increases, and penetration of the wick by the liquid deteriorates, accordingly.

Moreover, it should be noted that, in addition to the above-mentioned amount of emulsifier (D), 0.1 to 2 parts by weight of non-ionic surfactant are preferably added into the emulsion liquid during or after the polymerization. This additional step results in higher stability of the emulsion.

EXAMPLE

First, 85 parts by weight of 2-ethylhexyl acrylate, 5 parts by weight of acrylic acid, 10 parts by weight of methyl metacrylate and 0.2 parts by weight of polyethylen glycol alkyl ether (sold under the tradename Emulgen 930 by Kao corp. of Nihonbashi-Kayabacho, Chuoku, Tokyo 103, Japan) are added to 69 parts by weight of water and dispersed to obtain a water emulsion of mixed monomers. Then, the emulsion is mixed with 0.5 parts by weight of potassium peroxodisulfate, as an initiator, and polymerized at a temperature of 80° C. After polymerization, 2 by weight of polyethylen glycol alkyl ether (sold under the tradename Emulgen 930 by Kao corp.) was further added to the emulsion to obtain copolymer emulsion liquid. This emulsion liquid was neutralized with 5% potassium hydroxide aqueous solution to have a pH value of 6–8, and then water was added to the emulsion at an amount desired for regulation of the viscosity of the emulsion liquid to about 30 mPa.s, thereby obtaining adhesive liquid.

For an application test, the above adhesive emulsion liquid was poured into the bottle of an adhesive applier according to the first embodiment of the present invention (open-cell foamed support: density; 50 kg/m$^3$, open-cell rate: 97%, width of the notch: 2 mm). While pointing the adhesive applier downward, the felt wick of the applier was pressed on a paper sheet intermittently to open the valve.

After pressing the wick a few times, the copolymer emulsion liquid suitably penetrated the felt wick. The emulsion liquid was applied to the paper, and another sheet of paper was then placed on top of the liquid and pressed immediately. Ten seconds later, it was found that the paper sheets had been adhered sufficiently (initial bond strength: 0.15 kg/cm$^2$). After application, the condition of the adhesive applier was observed for a while. No overflow of emulsion liquid out of the felt wick was found.

It must be understood that the invention is in no way limited to the above embodiments and that many changes may be brought about therein without departing from the scope of the invention as defined by the appended claims.

What is claimed is:

1. An adhesive applier, comprising:

a container for an adhesive having at least 50% by weight solids content and containing emulsion micelles of a diameter within a range of 0.005 μm to 0.5 μm;

value means provided on the container for controllably supplying the adhesive from the container; and a server for receiving the adhesive supplied through the value means in order to serve the adhesive, the server comprising;

a holder coveting the outside of the valve means;

a wick permeable to the adhesive and extending from the inside of the holder to the outside thereof and being axially, slidably and fittingly supported by the holder, the permeable wick cooperating with the valve means to operate the valve means in response to axial movement of the permeable wick;

a support for slidably and fittingly supporting the permeable wick inside of the holder to facilitate transportation of the adhesive from the valve means to the permeable wick; and means for preventing the adhesive from leaking out of the server due to pressure change inside the server.

2. The adhesive applier of claim 1, wherein the preventing means includes a passage provided between the support and the permeable wick to communicate the inside of the holder with the outside thereof so that air inside the support can be released into the atmosphere.

3. The adhesive applier of claim 2, wherein the holder has an opening at which the permeable wick is supported, and the preventing means further incudes a clearance provided in part between the permeable wick and the opening of the holder.

4. The adhesive applier of claim 2, wherein the passage is formed on a surface of the support on which the permeable wick is supported.

5. The adhesive applier of claim 2, wherein the passage includes at least a pair of notches which are symmetrically positioned with respect to the axis of the permeable wick.

6. The adhesive applier of claim 5, wherein the notch has a width of 0.1 to 3 mm.

7. The adhesive applier of claim 1, wherein the support includes a part made of an open-cell material.

8. The adhesive applier of claim 7, wherein the open-cell material has an open-cell ratio of 70 to 100% by volume.

9. An adhesive applier, comprising:

container for an adhesive having at least a 50% by weight solids content and containing emulsion micelles of a diameter within a range of 0.005 μm to 0.5 μm;

piston means including a chamber and a slide wick permeable to the adhesive, the chamber being communicated with the container, and the slide wick being axially slidably supported in the chamber and extending to the outside of the chamber;

value means provided between the container and the chamber of the piston means so as to cooperate with the slide wick to controllably supply the adhesive from the container to the chamber in response to axial movement of the slide wick;

a support slidably and fittingly supporting the slide wick in the chamber of the piston means to facilitate transportation of the adhesive in the chamber to the slide wick; and means for preventing the adhesive from leaking out of the piston means due to pressure change inside the chamber.

10. The adhesive applier of claim 9, wherein the preventing means includes a passage formed between the support and the slide wick.

11. The adhesive applier of claim 10, wherein the preventing means further includes a clearance provided on the piston means near the slide wick.

12. The adhesive applier of claim 10, wherein the passage includes at least a pair of notches which are symmetrically positioned with respect to the slide wick.

13. The adhesive applier of claim 9, wherein the support includes a part made of an open-cell material.

14. The adhesive applier of claim 13, wherein an open-cell ratio of the open-cell material is within the range of 70 to 100% by volume.

15. An adhesive applier comprising:

a container for receiving an adhesive having at least a 50% by weight solids content and containing emulsion micelles of a diameter within a range of 0.005 μm to 0.5 μm; and a wick permeable to the adhesive, the permeable wick being adapted to the container and extending from the inside of the container to the outside thereof so that the adhesive can penetrate the permeable wick to discharge from the container.

16. An adhesive applier unit, comprising:

a container for a water emulsion adhesive having at least 50% by weight solids content and containing emulsion micelles of a diameter within a range of 0.005 μm to 0.5 μm and comprising a mixture of a copolymer and an emulsifier, a neutralizer, and a stabilizing surfactant;

wherein said mixture is 60 to 99.8 parts by weight of acrylic ester containing an alkyl radical having 4–12 carbons, 0.2 to 10 parts by weight of polymerizable unsaturated aliphatic acid and 1.0 to 12 parts by weight of emulsifier; said neutralizer is selected from the group consisting of sodium hydroxide and potassium hydroxide; and said stabilizing surfactant comprises 0.1 to 2 parts by weight and is introduced to said adhesive during or after copolymerization of the copolymer;

a value means for controllably supplying the adhesive from the container;

a server for receiving the adhesive supplied through the valve means in order to serve the adhesive, the server comprising;

a holder covering the outside of the valve means;

a wick member permeable to the adhesive and extending from the inside of the holder to the outside thereof and being axially slidably and fittingly supported by the holder, the permeable wick member cooperating with the valve means to operate the valve means in response to axial movement of the permeable wick member;

a support for slidably and fittingly supporting the permeable wick member inside of the holder to facilitate transportation of the adhesive from the valve means to the permeable wick member; and means for preventing the adhesive from leaking out of the server due to pressure change inside the server.

17. The adhesive applier unit of claim 16, wherein said mixture further comprises up to 39.8 parts by weight of a vinyl, radical-containing monomer.

18. An adhesive applier unit, comprising:

a container for a water emulsion adhesive having at least a 50% by weight solids content and containing emulsion micelles of a diameter within a range of 0.005 μm to 0.5 μm and comprising a mixture of a copolymer and an emulsifier, a neutralizer, and a stabilizing surfactant;

wherein said mixture is 60 to 99.8 parts by weight of acrylic ester containing an alkyl radical having 4–12 carbons, 0.2 to 10 parts by weight of polymerizable unsaturated aliphatic acid and 1.0 to 12 parts by weight of emulsifier; said neutralizer is selected from the group consisting of sodium hydroxide and potassium hydroxide; and said stabilizing surfactant comprises 0.1 to 2 parts by weight of the adhesive;

a piston means including a chamber and a slide member permeable to the adhesive, the chamber being communicated with the container, and the slide member being axially slidably supported in the chamber and extending to the outside of the chamber; and a valve means provided between the container and the chamber of the piston means so as to cooperate with the slide member to controllably supply the adhesive from the container to the chamber in response to axial movement of the slide member;

a support slidably and fittingly supporting the slide member in the chamber of the piston means to facilitate transportation of the adhesive in the chamber to the slide member; and means for preventing the adhesive from leaking out of the piston means due to pressure change inside the chamber.

* * * * *